United States Patent [19]

Nasvytis

[11] Patent Number: 4,804,313

[45] Date of Patent: Feb. 14, 1989

[54] SIDE CHANNEL SELF PRIMING FUEL PUMP HAVING RESERVOIR

[75] Inventor: Pius J. Nasvytis, Avon, Conn.

[73] Assignee: Colt Industries Inc, New York, N.Y.

[21] Appl. No.: 29,517

[22] Filed: Mar. 24, 1987

[51] Int. Cl.[4] ..... F04D 5/00

[52] U.S. Cl. ..... 415/53 T; 415/11; 415/144; 415/177

[58] Field of Search ..... 415/52, 53 T, 53 R, 415/55, 58, 213 T, 114, 11, 144, 177, 179

[56] References Cited

U.S. PATENT DOCUMENTS

| | | | |
|---|---|---|---|
| 923,680 | 6/1909 | Meyersberg | 415/52 |
| 1,920,484 | 8/1933 | Siemen et al. | 415/213 T |
| 3,007,417 | 11/1961 | Feltus | 415/213 T |
| 3,068,802 | 12/1962 | Costello et al. | 415/11 |
| 3,761,196 | 9/1973 | Weinert | 415/53 T |
| 3,942,906 | 3/1976 | Schonwald | 415/53 T |

*Primary Examiner*—Robert E. Garrett
*Assistant Examiner*—John T. Kwon
*Attorney, Agent, or Firm*—Howard S. Reiter

[57] ABSTRACT

A side channel pump (10) has a pumping cavity (26) which includes an inlet port (78), a discharge port (80) and side channels (72,74). An impeller (54) is mounted for rotation in the pumping cavity. A reservoir (20) holds an ample supply of liquid for pump priming and pump cooling during periods of gas pumping. A bypass suction duct (24) carries liquid from the reservoir to the pumping cavity during priming, gas pumping and normal operating and a bypass return duct (22) returns some discharged liquid to the reservoir during gas pumping and normal operation. The reservoir acts as a heat sink to enable the liquid ring formed during gas pumping operation to absorb more heat and provide pump cooling.

4 Claims, 2 Drawing Sheets

10
20
22
26
28
30
32
34
36
42
44
46
48
50
52
54
55
56
58
60
62
64
66
68
70
72
74
74A
74B
74C
76
78
78A
78B
80
82
84
86
88
90
3
4

SIDE CHANNEL SELF PRIMING FUEL PUMP HAVING RESERVOIR

TECHNICAL FIELD

This invention relates to side-channel pumps and more particularly to side-channel fuel pumps for gas turbine engines.

DISCLOSURE OF INVENTION

Side-channel pumps are inherently capable of efficiently handling gases, liquids or a mixture of gas and liquid and are somewhat self-priming. Gases in the liquid entering a side-channel pump or the evaluation of gases from volatile liquids (such as aircraft fuel) will not cause the pump to lose its prime and stop pumping. Two examples of side channel pumps are shown in U.S. Pat. Nos. 1,920,484 and 3,007,417.

However, the term "self-priming" as applied to a conventional side channel pump is slightly misdescriptive in that the pump must be filled with liquid before it is started for the first time. Thereafter, the residual charge of liquid which remains in the pump will obviate further priming, provided, however, that the liquid does not evaporate as may be occasioned if the liquid is hot or volatile.

Conventional side channel pumps suffer from a prominent drawback which limits the range of applications in which such pumps may be utilized viz.: they have a tendency to overheat while pumping gases when little or no liquid flow is present to remove the heat. Obviously, excessive heat generation by a pump can produce undesirable consequences with regard to pump life or even possibly create a hazardous condition.

DISCLOSURE OF THE INVENTION

In accordance with the invention there is provided a side-channel pump having a separate liquid reservoir to eliminate the need for initially priming the pump and, more importantly, to permit cooling of the pump when prolonged gas pumping is required.

The reservoir in a pump of the invention may be formed in part of the pump housing or casing or embodied in a separate casing. During gas pumping operation, fluid from the reservoir is conducted to the pumping cavity by a duct which communicates with a secondary inlet port in the suction area of the pump. Fluid from the pump discharge during such operation is delivered back to the reservoir. As a consequence of the aforementioned bypass loop, the liquid ring formed in the pumping cavity during gas pumping will function to remove heat from the pump and transfer it to the reservoir, which acts as a large heat sink.

Accordingly, it is a primary object of the invention to provide a side-channel pump which is self priming in the absence of sufficient fuel in the pump casing.

Another object is to provide a side-channel pump with a means to cool the pump during prolonged gas pumping operation.

These and other objects and advantages of the invention will become more readily apparent from the following detailed description, when taken in conjunction with the accompanying drawings, in which:

BEST MODE OF CARRYING OUT THE INVENTION

Figure 1:
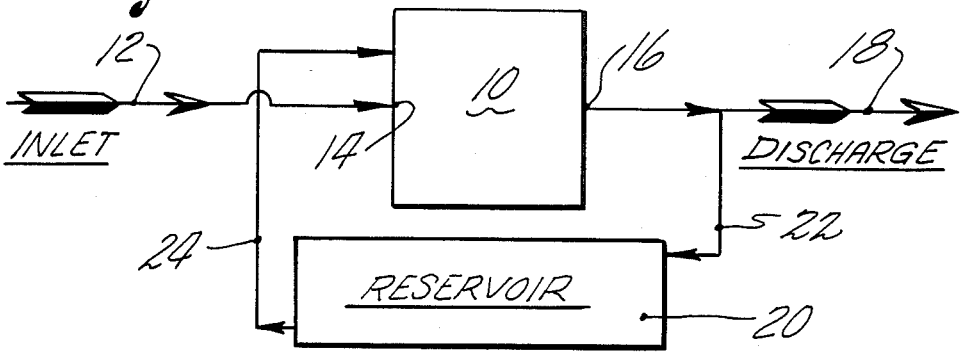
FIG. 1 is a schematic diagram of a side-channel pump according to the invention.

Referring to the drawings, wherein like reference characters refer to like parts throughout the several figures, a side-channel pump of the invention 10 is depicted in FIG. 1. Flow from an inlet conduit 12 enters a pump inlet 14 and proceeds thence through the pump to a pump outlet 16. Flow from outlet 16 enters a discharge conduit for delivery to a fluid consuming load such as an aircraft gas turbine engine. A portion of the discharge flow, destined to enter or already within the discharge conduit, is diverted to a reasonably sized reservoir 20 through a bypass return duct 22. Liquid in the reservoir is drawn into a bypass suction duct 24 which supplies liquid to a suction area of the pump via a secondary inlet port, thereby completing a bypass loop. During normal operation and gas pumping operation when flow demand is minimal there will always be flow in the bypass loop, albeit of a small magnitude.

Figures 2, 3, 4:
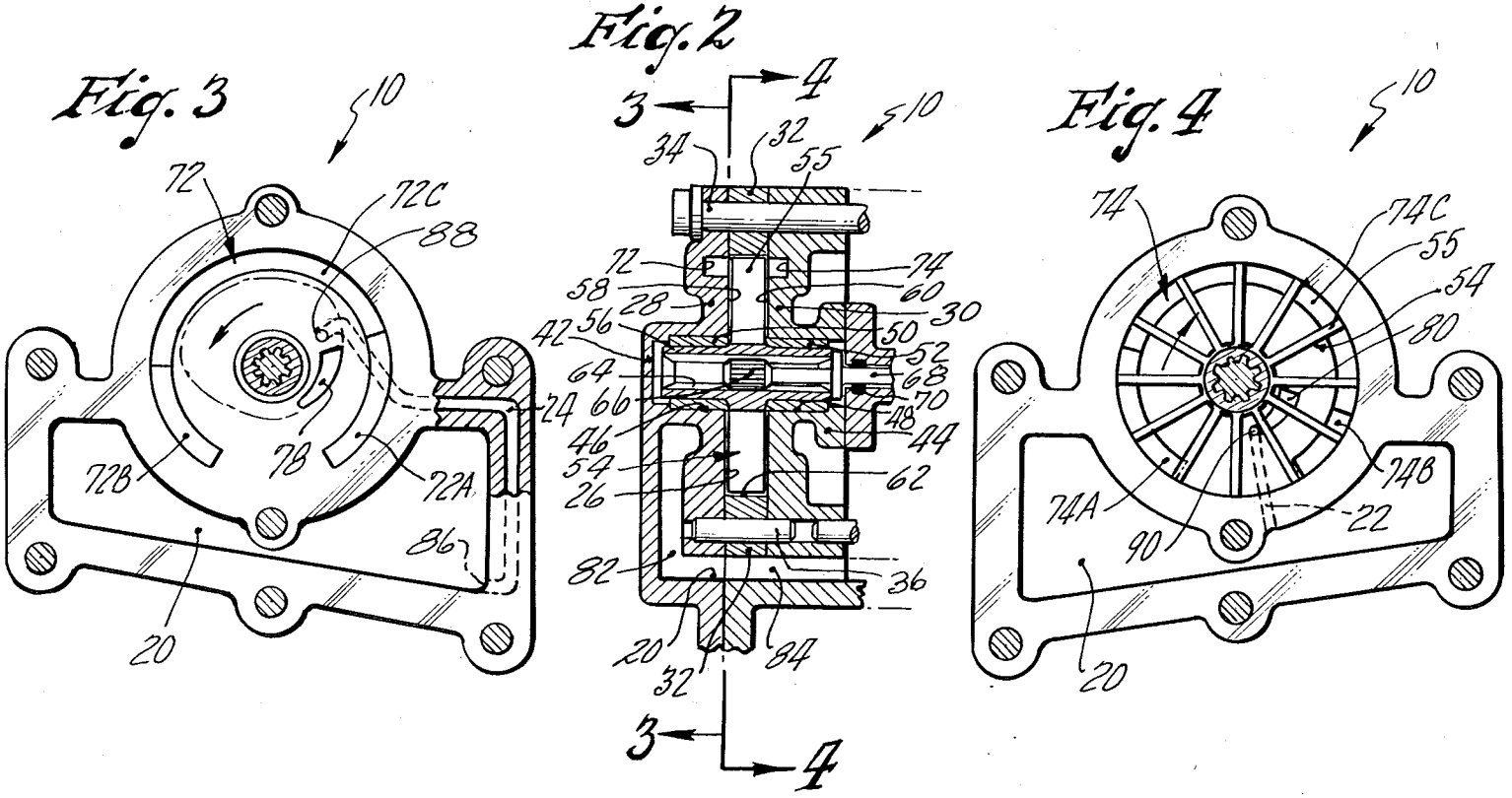
FIG. 2 is a longitudinal sectional view of a side-channel pump according to the invention.
FIGS. 3 and 4 are sectional views of the pump of FIG. 2, taken substantially along the lines 3–3 and 4–4, respectively.

FIGS. 2,3 and 4 show a preferred embodiment of a pump of the invention. A pumping cavity 26 is formed within a housing or casing by two housing sections 28 and 30 and a ring-shaped spacer 32 interposed therebetween in abutting relationship therewith. The housing sections 28 and 30 are held in firm engagement with the spacer 32 by a plurality of bolts 34 and maintained in proper angular relationship by a plurality of dowels 36 which are received within aligned bores in the housing sections 28 and 30 and spacer 32.

Housing sections 28 and 30 have portions 42 and 44 of sufficient width to allow the inclusion of aligned bores 46 and 48. A pair of fixed bearings 50 and 52 are respectively mounted within the bores 46 and 48. An impeller, generally shown at 54 and having radial vanes 55, is carried by an integral hollow shaft 56 journaled in the bearings 50 and 52. Impeller 54 is sized to have minimum running clearance between itself and the confronting surfaces of the pump in cavity 26, viz.: walls 58 and 60 which are respectively defined by the housing sections 28 and 30 and the radial interior periphery 62 of the spacer 32. Internal splines 64 within the shaft 56 are drivingly engaged by the external splines on the head 66 of a pump drive shaft 68 to provide a driving connection therebetween, whereby rotation may be imparted to the impeller 54. A shaft seal 70 is interposed between the drive shaft 68 and the housing section 30 to prevent leakage from the interior of the housing to the exterior of the housing.

Figure 5:
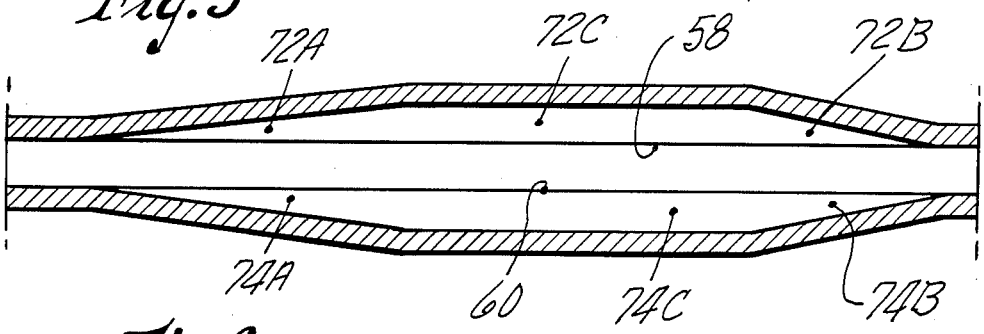
FIG. 5 is a schematic representation of the development of the channels.
Figure 6:
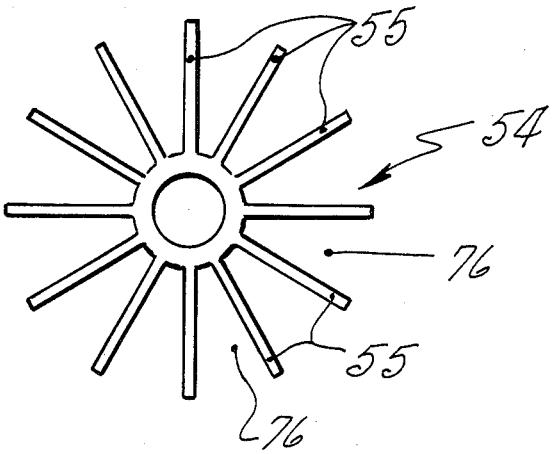
FIG. 6 is a front elevational view of the impeller, per se.

The walls 58 and 60 of the pumping cavity 26 are relieved to form segmental, circumferential pumping channels or grooves 72 and 74 which are coextensive and mirror images. As best seen in FIGS. 2 and 3, the outer radius of the channels is substantially equal to the radius of the impeller and the channels have a central angle of about three hundred degrees, whereby the ends of each channel are circumferentially spaced. The channels 72 and 74, which have segments 72A, 72B, 72C, 74A, 74B and 74C, are open only towards the impeller throughout their length and are gradually reduced in depth at both of their ends, as shown in the respective profiles of FIG. 5, so as to respectively merge with the walls 58 and 60. Such channel geometry with gradual increases and decreases in depth at both ends causes gradual liquid withdrawal or liquid return to the pockets 76 formed between the vanes (See FIG. 6). From FIGS. 2 and 3, it will be observed that the radially outer sides of the vanes 55 pass directly over the channels, thereby insuring continuous communication between the pockets 76 and the channels 72 and 74.

As is apparent from FIG. 3, the impeller 54 rotates in a counterclockwise direction such that the vanes 55 travel from the suction area of the pump 10 (where channel segment 72A has a depth which progressively increases) to a discharge area of the pump (where channel segment 72B has depth which progressively decreases). Housing section 28 is provided with a main inlet port 78 in the suction area through which incoming fluid is directed into the pumping cavity between the housing sections 28 and 30 and spacer 32, whereas housing section 30 incorporates a main discharge port 80 (FIG. 4) in the discharge area of the pump 10 from where fluid finds egress from the pumping cavity 26. Main inlet port 78 and Main discharge port 80 are respectively fluidly connected to the pump inlet 12 and the pump outlet 16 by means of suitable passages (not shown). While it is unnecessary to describe the detailed operation of conventional side channel pumps since their operation is well understood by those skilled in the art, it simply should be noted that the energy increment of liquid flowing through such a pump, which is produced by the interchange of impulses between the liquid in the pockets and the liquid in the side-channels, is so large that the total head for this type of pump may be between two and three times greater than that of an ordinary impeller pump with similar parameters. This together with its gas pumping capabilities, may render such a pump suitable for use in association with aircraft gas turbine engine controls.

As previously noted, as pumping for a long period of time by a side channel pump, with little or no liquid being pumped, is liable to overheat the pump. To prevent such an occurrence, reservoir 20 functions as a heat sink. From FIGS. 2,3 and 4, it will be seen that the reservoir 20 is formed in an extension of the housing by confronting cavities 82 and 84 in housing sections 28 and 30, respectively. The bypass suction duct 24 (shown partially by dashed lines) defined in the housing section 28 communicates with the liquid residing in the reservoir 20 via a suction duct inlet port 86. The other end of the suction duct 24 communicates with a secondary inlet port 88 to pumping cavity 26 which is formed in the wall 58 of the housing section.

With reference to FIG. 4, the bypass return duct 22 (shown by dashed lines) fluidly interconnects the discharge port 80 with the reservoir 20 by means of a secondary discharge port 90 formed in the housing section 30 adjacent the discharge port.

In a traditional side channel pump, the pumping cavity must be supplied with liquid before pumping operation can commence. Thereafter, impeller rotation causes liquid to be thrown outwardly into the side channels, thereby forming a free space around the hub which draws air from the inlet conduit via the inlet port. Concurrently therewith, the diminishing channel depth occasions a return of liquid to the pockets in the impeller, thereby resulting in a discharge through the discharge port of the air originally drawn into the pumping cavity. After repeated revolutions of the impeller, air or gas will be evacuated from the inlet conduit whereby the pump will draw in and discharge liquid from the inlet port and discharge port, respectively.

The operation of the aforedescribed pump 10 of the invention is, of course, fundamentally similar, except that priming can be effectuated solely by the liquid in the reservoir 20. When pump 10 attains a sufficient speed after initial starting, fuel in the reservoir 20 will be drawn through the bypass suction duct 24 and enter pumping cavity 26 through the secondary inlet port 88. After repeated revolutions of the impeller 54, a peripheral liquid ring will develop, thereby creating gas pumping geometry as would exist in a traditional side channel pump after priming. Eventually, the liquid rotating with the impeller 54 forms a seal between the inlet port 78 and the discharge port 80 as in a traditional side channel pump; and finally, after the all air is expelled from the inlet conduit 12, only fuel is drawn into the pumping cavity 26 and pumped therefrom.

During gas pumping operation, a traditional side channel pump and a pump of the invention will develop a liquid ring. The typical kidney-shaped outline of such a ring is shown in phantom in FIG. 3, it being understood that gas lies within the boundaries thereof. Substantial heat will be generated by the pumping operation should gas pumping continue for a period of time; and the heat generation will cause a temperature rise in the liquid ring. However, in a pump of the invention, liquid in the ring will be constantly exchanged for liquid in the reservoir by the flow through the secondary inlet port 88 and the secondary discharge port 90. Hence, the heat generated during gas pumping, which is absorbed by the liquid ring, will be rejected to the reservoir 20, which acts as a heat sink, thereby cooling the pump 10.

The design and location of the reservoir 20 admits of many variations. However, it will be understood that the reservoir should be capable of collecting and preserving liquid for a long period of time and have a sufficient capacity to act as a heat sink.

Obviously, many modifications and variations are possible in light of the above teachings without departing from the scope or spirit of the invention as defined in the appended claims.

I claim:

1. An improved side channel pump of the type comprising: a pump housing having an inlet and an outlet and a pumping cavity therein; the pumping cavity having a wall with an inlet port in the suction area of the wall and a discharge port in the discharge area of the wall and a circumferential side channel, the inlet being fluidly connected to the inlet port for supplying fluid thereto and the discharge port being fluidly connected to the outlet for supplying fluid thereto; and an impeller mounted in the housing for rotation in the pumping cavity, wherein the improvement comprises:

a reservoir for containing a supply of liquid;

a bypass suction duct for carrying liquid from the reservoir to the pumping cavity;

a suction duct inlet port in the reservoir for conducting liquid in the reservoir to the bypass suction duct;

a secondary inlet port in the pumping cavity wall in the suction area thereof for conducting liquid in the bypass suction duct to the pumping cavity; and means to conduct liquid in the discharge area of the pumping cavity wall to the reservoir.

2. The improved side channel pump of claim 1, wherein the liquid conducting means comprises:

a bypass return duct; and a secondary outlet port in fluid communication with the discharge port for conducting flow from the discharge port to the bypass return duct.

3. The improved pump of claim 1, wherein the improvement further comprises:

the reservoir being formed in an extension of the pump housing.

4. A method of operating a side channel pump having a suction area and a discharge area comprising:

priming the pump after it attains sufficient speed by directing liquid from a reservoir to the suction area;

continuing to direct liquid from the reservoir to the suction area after the pump is primed and returning at least some discharge flow to the reservoir;

directing liquid from a liquid ring, which has developed during prolonged gas pumping operation, to a reservoir; and directing liquid from the reservoir to the suction area of the pump during said gas pumping operation.

* * * * *